United States Patent [19]

Woratyla

[11] 4,341,431

[45] Jul. 27, 1982

[54] STRAIN RELIEF

[75] Inventor: John A. Woratyla, Camp Hill, Pa.

[73] Assignee: AMP Incorporated, Harrisburg, Pa.

[21] Appl. No.: 160,056

[22] Filed: Jun. 16, 1980

[51] Int. Cl.[3] ..... H01R 13/58

[52] U.S. Cl. ..... 339/103 M

[58] Field of Search ..... 339/103 R, 103 C, 103 M, 339/104, 105

[56] References Cited

U.S. PATENT DOCUMENTS

| | | | |
|---|---|---|---|
| 3,562,870 | 2/1971 | Sund | 24/16 |
| 3,671,921 | 6/1972 | Baker et al. | 339/59 M |
| 3,694,863 | 10/1972 | Wasserlein | 24/16 PB |
| 3,830,263 | 8/1974 | Benfer | 140/93.2 |
| 3,854,787 | 12/1974 | Snyder | 339/103 R |
| 3,891,012 | 6/1975 | Bakermans | 140/93 A |
| 3,904,265 | 9/1975 | Hollyday et al. | 339/103 M |
| 4,067,633 | 1/1978 | Groft et al. | 339/74 R |
| 4,080,035 | 3/1978 | Clark et al. | 339/103 |
| 4,244,638 | 1/1981 | Little et al. | 339/103 M |

FOREIGN PATENT DOCUMENTS

| | | | |
|---|---|---|---|
| 2051914 | 4/1972 | Fed. Rep. of Germany | 339/103 M |

*Primary Examiner*—Joseph H. McGlynn

*Attorney, Agent, or Firm*—Russell J. Egan

[57] ABSTRACT

An improved strain relief device is disclosed for use in cooperation with a known electrical connector of the type having at least two parallel spaced rows of terminals separated by a slot. The subject strain relief device is snapped into the slot in the connector and has the conductors of the respective rows secured to the opposite sides thereof by means of a known bundle tie passing around the conductors and through a slot in the strain relief device.

2 Claims, 3 Drawing Figures

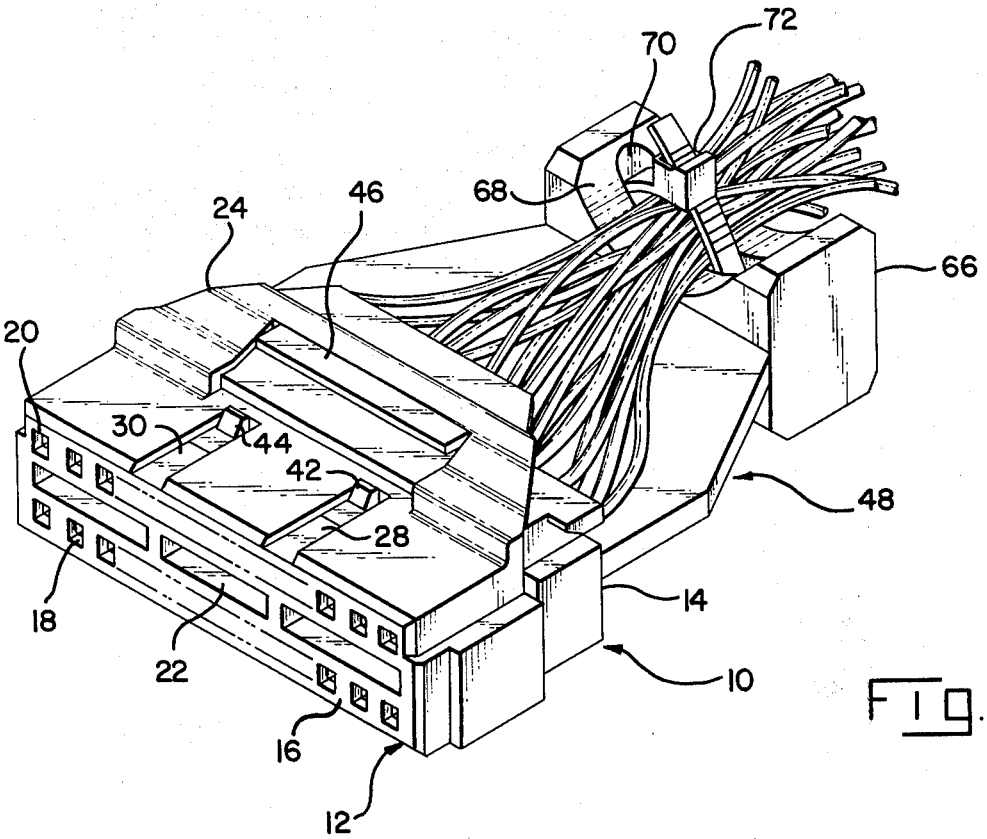
FIG. 2
FIG. 3
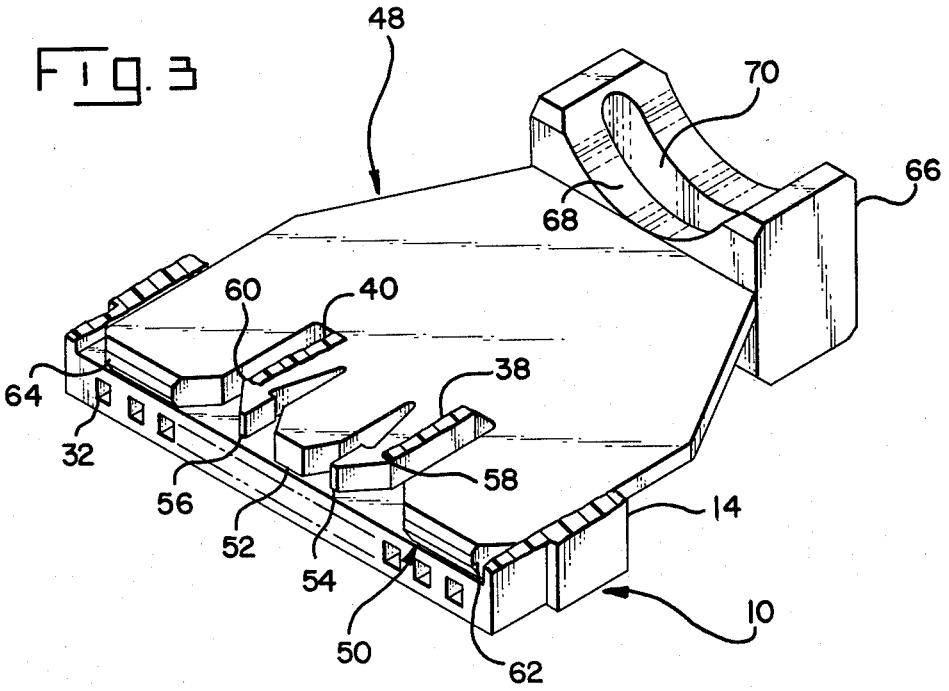

STRAIN RELIEF

BACKGROUND OF THE INVENTION

1. The Field Of The Invention

The present invention relates to an improved strain relief member for electrical connectors and in particular to a strain relief member which can be snapped into place in a centrally disposed elongated slot in a known electrical connector housing.

2. The Prior Art

The previously used strain relief members have been generally of two types. The first type is a strain relief which forms an integral part of the housing, for example as shown in U.S. Pat. No. 3,854,787. This integral arrangement can make the housing quite cumbersome and bulky as well as expensive for those instances when a strain relief is not necessary. A second type of strain relief is one which is added to an existing housing. These can be permanently fixed to the housing, for example, as shown by U.S. Pat. No. 4,080,035 or detachably secured to the housing as shown by U.S. Pat. Nos. 3,671,921 and 3,904,265. The present invention is of the detachable type and represents an improvement over the snap-in strain relief disclosed in U.S. Pat. No. 4,244,638.

SUMMARY OF THE INVENTION

The present invention is intended to overcome the deficiencies of the prior art by providing a strain relief member to be used in combination with a known electrical connecting housing having two parallel spaced terminal carrying portions defining at least one elongated slot therebetween. The subject strain relief member itself is formed of a unitary piece of rigid insulation material and has a profiled forward end defining an integral pair of legs adapted to snap fit within the slot of an associated connector housing. The strain relief member also includes a rearwardly disposed portion having oppositely outwardly directed concave profiles with a slot extending therebetween. The conductors of the connector are gathered in the respective concave areas and are secured by a bundle tie extending through the slot and around the conductors.

It is therefore an object of the present invention to produce an improved strain relief member for electrical conductors which member can be detachably secured to a known electrical connector.

It is another object of the present invention to produce a detachable strain relief member which can be readily and economically manufactured.

The means for accomplishing the foregoing objects and other advantages of the present invention will become apparent to those skilled in the art from the following detailed description taken with reference to the accompanying drawings.

BRIEF DESCRIPTION OF THE DRAWINGS

FIG. 2 is a perspective view of the subject strain relief member fully assembled with the connector of FIG. 1; and FIG. 3 is a perspective view, partially in section, showing the engagement of the subject strain relief in the connector member.

DETAILED DESCRIPTION OF THE PREFERRED EMBODIMENT

Figure 1:
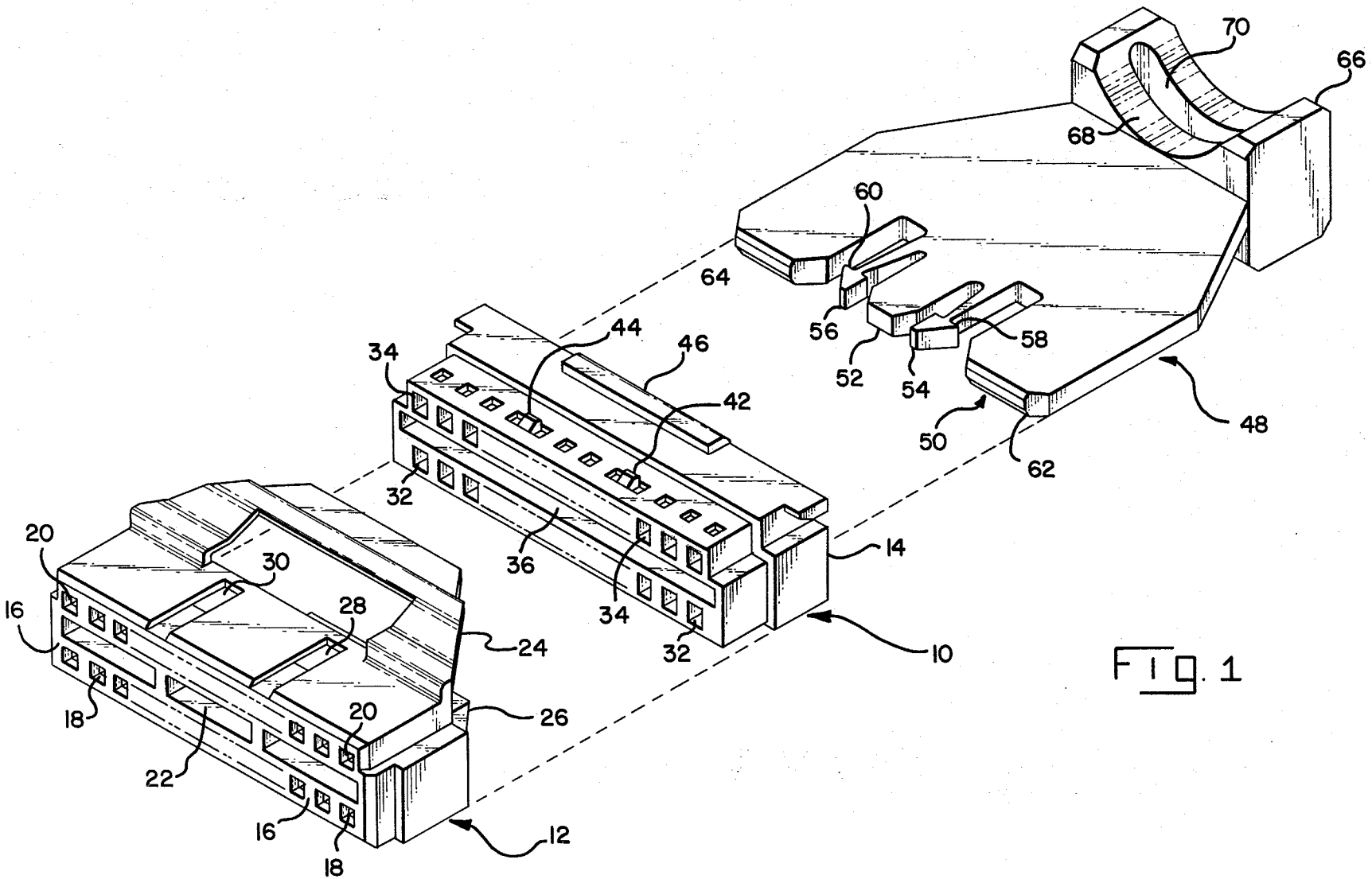
FIG. 1 is an exploded perspective view of the subject strain relief and an associated electrical connector.

The electrical connector 10 shown in FIGS. 1 and 2 is of the type shown in U.S. Pat. No. 4,067,633, the disclosure of which is incorporated herein by reference. The primary difference between the illustrated connector and that of the patent is that the two rows of terminals and their respective housing portions are spaced apart to provide an elongated slot therebetween in the present embodiment.

The subject connector 10 has an outer housing member 12 and an inner housing member 14. The outer housing member has a mating face 16 with two spaced rows of passages 18, 20 and a centrally disposed elongated slot 22. The outer housing member also includes a rearwardly directed cavity (not shown) with handle members 24, 26 extending rearwardly from opposite sides of the cavity. Slots 28, 30 are formed in opposed side walls of the outer housing member. The inner housing member 14 is adapted to be received in the cavity in the outer member and has a plurality of terminal passages 32, 34 arranged in two parallel spaced apart rows defining a slot 36 therebetween. The slot is divided into segments by recessed pillars 38, 40 (see FIG. 3). The module also includes lugs 42, 44 which are aligned to engage in the slots 28, 30, respectively, and rearwardly directed cam surfaces 46 on opposite sides which cooperate with the handles 24, 26 to effect relative movemnt between the inner and outer housing members 14, 12 in the manner described in the above mentioned U.S. patent to effect opening and closing of the terminals (not shown) carried thereby.

The subject strain relief 48 is molded from a single piece of plastics material and has an overall rectangular profile with a forward edge 50 profiled to be received in the slot 36 of the inner housing member. The profiled edge includes a central lug 52 flanked by a pair of legs 54, 56, each leg having rearwardly directed shoulders 58, 60 near the free ends thereof. Stabilizer projections 62, 64 are at each end of edge 50. The opposite end of the subject strain relief member 48 is formed as an integral block 66 forming oppositely and outwardly directed concave profiles 68 with a slot 70 extending between the surfaces 68 of the block 66.

The subject strain relief member 48 is mounted on the connector by inserting edge 50 into the slot 36 until the legs 54, 56 engage the pillars 38, 40 of the connector, as shown in FIG. 3, to hold the member 48 in place. It will be noted from this Figure how the stabilizer projections 62, 64 lie within the slot and prevent any undesired rotation or movement of the member. The central lug 52 serves to prevent overflexure of the legs 54, 56 during and mounting or unmounting of the member.

A bundle tie 72 of known configuration, such as those described in U.S. Pat. Nos. 3,562,870 and 3,694,863, secures the conductors 74 to the strain relief member 48 by passing around the conductors and through slot 70. The bundle tie 72 can be applied by any known tool, such as those described in U.S. Pat. Nos. 3,830,263 and 3,891,012.

The present invention may be subject to many modifications and changes without departing from the spirit or essential characteristics thereof. The present embodiment should therefore be considered in all respects as illustrative and not restrictive of the scope of the invention.

What is claimed is:

1. In combination with an electrical connector having a housing with at least two parallel spaced terminal carrying portions defining at least one elongated slot between each pair of portions and at least one pair of parallel spaced pillars sub-dividing said slot into a plurality of passages, a strain relief member adapted to be detachably mounted on said connector, said strain relief member comprising:

a unitary member of rigid insulative material having an overall rectangular profile with a forward edge profiled to define an integral pair of legs on opposite sides of a central lug, each leg having an outwardly directed shoulder adjacent the free end and stabilizes flanges extending from said forward edge to either side of said legs and engageable in a respective one of said passages in said elongated slot of said housing;

a block formed on an opposite rear edge of said member with an outwardly directed concavity formed on each side of the block and a through slot extending between said surfaces; and bundle tie means whereby conductors extending from said connector and lying in said concavities are encircled by said bundle tie means passing through said slot to secure them to said member.

2. A strain relief member for selective and removable attachment to an electrical connector housing having at least one elongated slot formed therein, said strain relief member comprising:

a rigid plate of insulating material having a generally rectangular configuration with a profiled forward edge and an integral block on an opposing rear edge;

said block having outwardly and oppositely directed concave profiles and a slot extending between said profiles;

bundle tie means passing through said slot and encircling conductors positioned in said profiles; and a pair of integral legs extending from said profiled forward edge of said plate, the free end of each leg having an outwardly sloped surface defining an outwardly and rearwardly directed shoulder an integral stud centrally disposed of said legs to prevent over flexture of said legs and stabilizer flanges extending from said forward edge to either side of said legs and engageable in said elongated slot in said housing, said member being detachably secured in said elongated slot in said connector housing by said legs and held against rotational movement by said stabilizer flanges.

* * * * *